US007540838B2

(12) United States Patent
Scott et al.

(10) Patent No.: US 7,540,838 B2
(45) **Date of Patent: *Jun. 2, 2009**

(54) CENTRIFUGE CONTROL IN RESPONSE TO VISCOSITY AND DENSITY PARAMETERS OF DRILLING FLUID

(75) Inventors: Eric L. Scott, Conroe, TX (US); Lyndon Ray Stone, Humble, TX (US); Richard James Koch, Magnolia, TX (US)

(73) Assignee: Varco I/P, Inc., Houston, TX (US)

( * ) Notice: Subject to any disclaimer, the term of this patent is extended or adjusted under 35 U.S.C. 154(b) by 670 days.

This patent is subject to a terminal disclaimer.

(21) Appl. No.: 11/338,433

(22) Filed: Jan. 24, 2006

(65) Prior Publication Data

US 2007/0087927 A1 Apr. 19, 2007

Related U.S. Application Data

(63) Continuation-in-part of application No. 11/253,062, filed on Oct. 18, 2005.

(51) Int. Cl.
*B04B 1/20* (2006.01)
*B04B 13/00* (2006.01)

(52) U.S. Cl. ..... 494/7; 494/10; 494/37; 494/42; 494/53

(58) Field of Classification Search ..... 494/1, 494/5, 7–10, 12, 27, 30, 37, 42, 52–54, 84; 210/97, 103, 134, 143, 380.3; 700/273
See application file for complete search history.

(56) References Cited

U.S. PATENT DOCUMENTS 1,885,154 A 11/1932 Strezynski et al.
2,219,312 A 10/1940 Hayward et al.
2,341,169 A 2/1944 Wilson et al.
2,578,456 A 12/1951 Smith
2,711,854 A 6/1955 Kjellgren
2,895,669 A * 7/1959 Bobo ..... 494/10
2,928,546 A * 3/1960 Church ..... 210/319
2,941,783 A 6/1960 Stinson
2,954,871 A 10/1960 Lummus et al.
2,955,753 A * 10/1960 O'Conor et al. ..... 494/5
2,961,154 A 11/1960 Bergey
3,070,291 A * 12/1962 Bergey ..... 494/1
3,268,159 A 8/1966 Kern (Continued)

FOREIGN PATENT DOCUMENTS

EP 0936 344 A2 2/1999

(Continued)

*Primary Examiner*—Charles E Cooley
(74) *Attorney, Agent, or Firm*—Guy McClung

(57) ABSTRACT

A system for controlling viscosity of drilling fluid, the system, in certain aspects, including a container of the material, a viscosity sensor in the container for producing viscosity signals, a centrifuge for removing solids from the material, drive apparatuses for driving a rotatable bowl and a rotatable conveyor of the centrifuge, pump apparatus for pumping material, drive apparatus for the pump apparatus, and a control system for controlling the centrifuge and the pump apparatus in response to viscosity signals so that selected solids from material processed by the centrifuge are removed to control viscosity of drilling fluid material in the container; and in certain aspects, a similar system for controlling density of a drilling fluid material.

21 Claims, 4 Drawing Sheets

U.S. PATENT DOCUMENTS 3,498,393 A 3/1970 West et al.
3,726,136 A 4/1973 McKean et al.
3,795,361 A 3/1974 Lee
3,885,734 A 5/1975 Lee
3,934,792 A 1/1976 High et al.
3,955,411 A 5/1976 Lawson, Jr.
4,000,074 A 12/1976 Evans
4,085,888 A 4/1978 Jager
4,208,906 A 6/1980 Roberts, Jr.
4,224,821 A 9/1980 Taylor et al.
4,228,949 A 10/1980 Jackson
4,240,578 A 12/1980 Jackson
4,297,225 A 10/1981 Hartley
4,298,160 A 11/1981 Jackson
4,298,162 A 11/1981 Hohne
4,298,572 A 11/1981 Moffet et al.
4,319,482 A 3/1982 Bunner
4,339,072 A 7/1982 Hiller
4,369,915 A 1/1983 Oberg et al.
4,378,906 A 4/1983 Epper et al.
4,635,735 A 1/1987 Crownover
4,668,213 A 5/1987 Kramer
4,743,226 A 5/1988 Day et al.
4,805,659 A 2/1989 Gunnewig et al.
4,961,722 A 10/1990 Taylor et al.
5,010,966 A 4/1991 Stokley et al.
5,147,277 A 9/1992 Shapiro
5,156,751 A * 10/1992 Miller ..... 210/787
5,203,762 A 4/1993 Cooperstein
5,344,570 A * 9/1994 McLachlan et al. ..... 210/709
5,378,364 A 1/1995 Welling
5,403,260 A 4/1995 Hensley
5,494,584 A * 2/1996 McLachlan et al. ..... 210/739
5,632,714 A 5/1997 Leung et al.
5,643,169 A 7/1997 Leung et al.
5,653,674 A 8/1997 Leung
5,681,256 A 10/1997 Nagafuji
5,695,442 A 12/1997 Leung et al.
5,771,601 A 6/1998 Veal et al.
5,772,573 A 6/1998 Hao
5,814,230 A 9/1998 Willis et al.
5,857,955 A * 1/1999 Phillips et al. ..... 494/5
5,899,844 A * 5/1999 Eberle, Sr. ..... 494/37
5,913,767 A 6/1999 Feldkamp et al.
5,919,123 A * 7/1999 Phillips ..... 494/7
5,942,130 A 8/1999 Leung
5,948,256 A 9/1999 Leung
5,948,271 A 9/1999 Wardwell et al.
5,958,235 A 9/1999 Leung
6,045,070 A 4/2000 Davenport
6,063,292 A 5/2000 Leung
6,105,689 A 8/2000 McGuire et al.
6,109,452 A 8/2000 Leung et al.
6,110,096 A 8/2000 Leung et al.
6,123,656 A 9/2000 Michelsen
6,143,183 A 11/2000 Wardwell et al.
6,145,669 A 11/2000 Leung
6,217,830 B1 4/2001 Roberts et al.
6,267,250 B1 7/2001 Leung et al.
6,290,636 B1 9/2001 Hiller, Jr. et al.
6,308,787 B1 10/2001 Alft
6,315,894 B1 11/2001 Wiemers et al.
6,368,264 B1 * 4/2002 Phillips et al. ..... 494/5
6,378,628 B1 4/2002 McGuire et al.
6,461,286 B1 10/2002 Beattey
6,536,540 B2 3/2003 deBoer
6,605,029 B1 8/2003 Koch et al.
6,780,147 B2 8/2004 Koch et al.
6,790,169 B2 9/2004 Koch et al.
6,860,845 B1 * 3/2005 Miller et al. ..... 494/1
6,905,452 B1 * 6/2005 Kirsch ..... 494/8
6,926,101 B2 * 8/2005 deBoer ..... 175/70
6,932,169 B2 8/2005 Wylie et al.
6,932,757 B2 8/2005 Beattey
6,971,982 B1 * 12/2005 Kirsch ..... 494/8
7,001,324 B2 2/2006 Hensley et al.
7,018,326 B2 3/2006 Koch et al.
7,041,044 B2 5/2006 Gilbert
D524,825 S 7/2006 Koch et al.
7,387,602 B1 * 6/2008 Kirsch ..... 494/8
2002/0074269 A1 6/2002 Hensley et al.
2006/0105896 A1 * 5/2006 Smith et al. ..... 494/7
2007/0084639 A1 * 4/2007 Scott et al. ..... 175/286
2007/0087927 A1 * 4/2007 Scott et al. ..... 494/7

FOREIGN PATENT DOCUMENTS

JP 10337598 A * 12/1998
WO WO 89/09091 3/1999

* cited by examiner

CENTRIFUGE CONTROL IN RESPONSE TO VISCOSITY AND DENSITY PARAMETERS OF DRILLING FLUID

RELATED APPLICATION

This a continuation-in-part of U.S. application Ser. No. 11/253,062 filed on Oct. 18, 2005, incorporated fully herein for all purposes and from which the present invention claims priority under the Patent Laws.

BACKGROUND OF THE INVENTION

1. Field of the Invention

This invention related generally to centrifuges, to centrifuges for processing drilling fluids or muds, and to methods of their use.

2. Description of Related Art

Centrifuges used in the oil industry process drilling fluids known as "mud" to separate undesired drilling solids from liquid mud. Some centrifuges, because of their continuous operation, have the advantage of being less susceptible to plugging by solids. Also, they may be shut down for long or short periods of time and then restarted with minimum difficulty, unlike certain centrifuges which require cleaning to remove dried solids. Often the solids/liquid mixture is processed at high feed rates.

To accommodate high feed rates, high torques can be encountered, much energy is required to process the mixture, and the centrifuge can be of considerable size.

When such a centrifuge is used to process drilling material (drilling fluid with drilled cuttings therein), changing mud flow conditions often require a human operator to frequently adjust centrifuge pump speeds to optimize centrifuge treating performance. Centrifuge operation can be a compromise between high performance and long intervals between maintenance and repair operations.

In some instances, a centrifuge is used in an effort to control the plastic viscosity of mud. A desired plastic viscosity is a function of the type of mud (water, oil, synthetic-based), the mud density, and other variables. When mud viscosity is too high, the feed pump is run faster; when mud viscosity is too low, the feed pump is run slower or turned off. Often mud properties are measured only periodically, resulting in a saw-tooth effect on the mud viscosity.

SUMMARY OF THE PRESENT INVENTION

The present invention discloses, in certain aspects, a system for controlling viscosity of drilling fluid, the system including: a container of drilling fluid material, the drilling fluid containing solids; a viscosity sensor for sensing viscosity of the drilling fluid material in the container and for producing viscosity signals indicative of said viscosity; a centrifuge for removing solids from the drilling fluid material, the centrifuge having a rotatable bowl and a rotatable screw conveyor; pump apparatus for pumping drilling fluid material from the container to the centrifuge; bowl drive apparatus for driving the rotatable bowl; conveyor drive apparatus for driving the rotatable conveyor; pump drive apparatus for driving the pump apparatus; and a control system for receiving viscosity signals from the viscosity sensor and for controlling the centrifuge and the pump apparatus in response to said viscosity signals so that selected solids (e.g. fine solids that increase viscosity, e.g., in certain aspects, drilled solids less than twenty microns in a largest dimension and/or barite solids less than ten microns in a largest dimension) from drilling fluid material processed by the centrifuge are removed and, in one particular aspect, desirable larger solids are introduced back into the container (e.g. barite solids with a largest dimension greater than ten microns or greater than twenty microns, and/or drilling solids with a largest dimension greater than twenty microns).

The present invention discloses, in certain aspects, a system for controlling viscosity of drilling fluid, the system including: a container of drilling fluid material, the drilling fluid containing solids; a viscosity sensor for sensing viscosity of the drilling fluid material in the container and for producing viscosity signals indicative of said viscosity; a centrifuge for removing solids from the drilling fluid material, the centrifuge having a rotatable bowl and a rotatable screw conveyor; pump apparatus for pumping drilling fluid material from the container to the centrifuge; bowl drive apparatus for driving the rotatable bowl; conveyor drive apparatus for driving the rotatable conveyor; pump drive apparatus for driving the pump apparatus; and a control system for receiving viscosity signals from the viscosity sensor and for controlling the centrifuge and the pump apparatus in response to said viscosity signals so that selected solids from drilling fluid material processed by the centrifuge are reintroducible back into the container to control viscosity of drilling fluid material in the container.

In certain aspects, centrifuges in system according to the present invention are run at a G-force of 700 G's or greater, e.g. up to 1000 G's, in systems for controlling density and at less than 700 G's in systems for controlling viscosity.

In certain embodiments, the present invention discloses a centrifuge system that automatically controls drilling mud viscosity in a drilling system. Sensors measure mud viscosity and mud density. The mud density is used to determine an optimal viscosity. The optimal viscosity is used then as a set point for a control system. A value of measured viscosity is compared to the desired set point value. Based on this comparison, action is taken to increase or decrease mud viscosity, resulting in the maintenance of optimum and consistent mud properties. In certain aspects, the need for operator intervention is reduced or eliminated.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious drilling fluid viscosity control and/or density control systems and methods of their use.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 4:
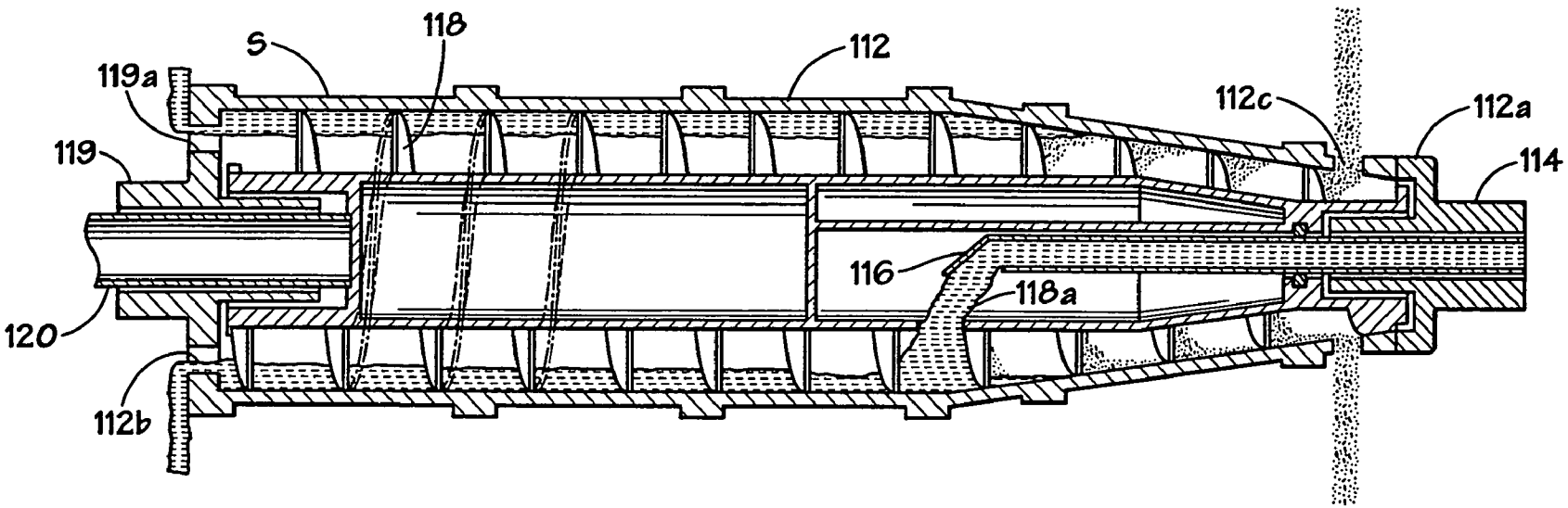
FIG. 4 (PRIOR ART)
FIG. 4 is a side view of a prior art centrifuge.

As shown in FIG. 4, a prior art centrifuge system S according to the present invention has a bowl 112, supported for rotation about its longitudinal axis, has two open ends 112*a* and 112*b*, with the open end 112a receiving a drive flange 114 which is connected to a drive shaft for rotating the bowl. The drive flange 114 has a longitudinal passage which receives a feed tube 116 for introducing a feed slurry, e.g. drilling material, into the interior of the bowl 112. A screw conveyor 118 extends within the bowl 112 in a coaxial relationship thereto and is supported for rotation within the bowl A hollow flanged shaft 119 is disposed in the end 112*b* of the bowl and receives a drive shaft 120 of an external planetary gear box for rotating the screw conveyor 118 in the same direction as the bowl at a selected speed. The wall of the conveyor 18 has one or more openings 118*a* near the outlet end of the tube 116 so that the centrifugal forces generated by the rotating bowl 112 move the slurry radially outwardly and pass through the openings 118a and into the annular space between the conveyor and the bowl 112. The liquid portion of the slurry is displaced to the end 112*b* of the bowl 112 while entrained solid particles in the slurry settle towards the inner surface of the bowl due to the G' forces generated, and are scraped and displaced by the screw conveyor 118 back towards the end 112*a* of the bowl for discharge through a plurality of discharge ports 112*c* formed through the wall of the bowl 112 near its end 112*a*.

Weirs 119*a* (two of which are shown) are provided through the flanged portion of the shaft 19 for discharging the separated liquid.

Figure 1:
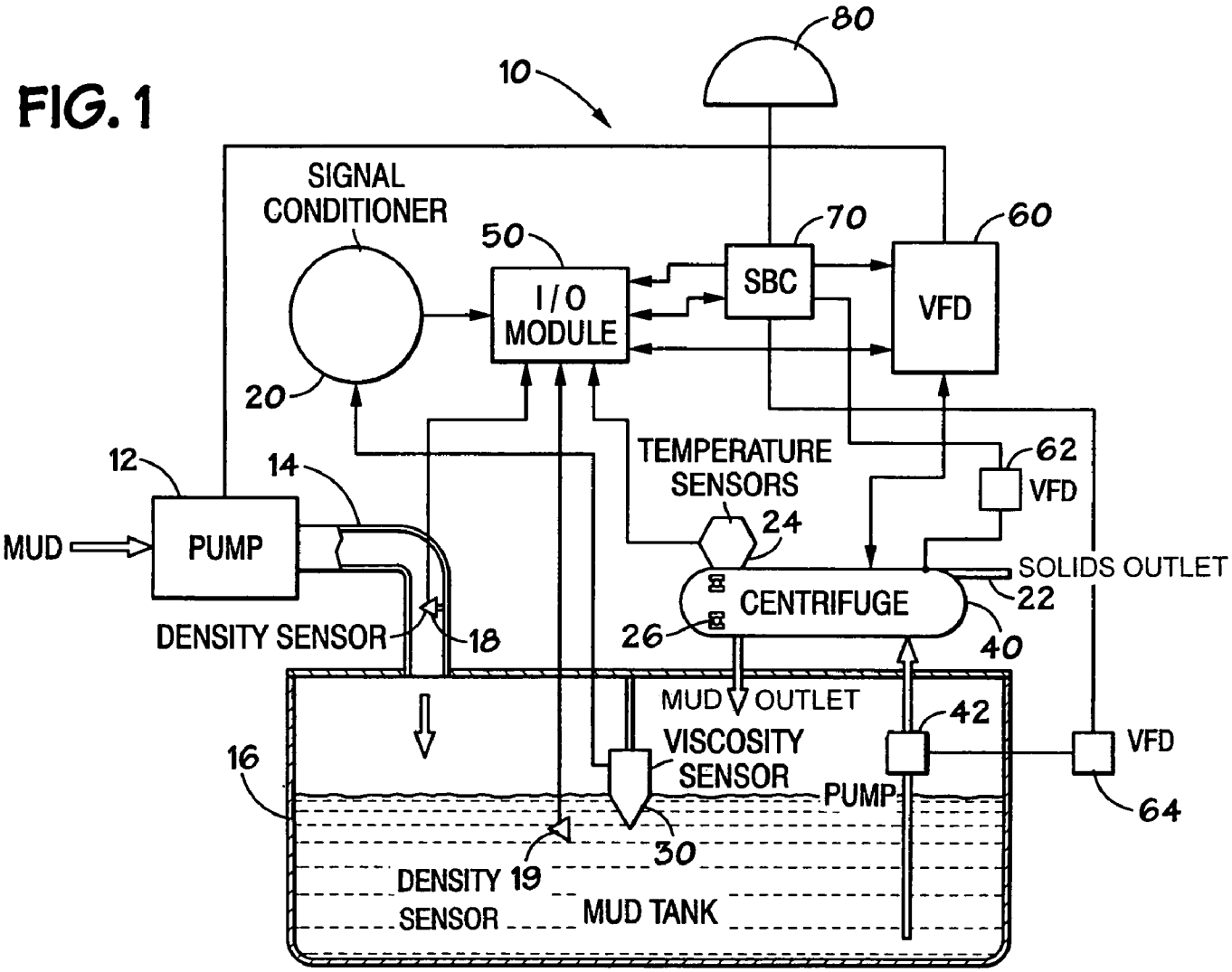
FIG. 1 is a schematic view of a centrifuge system according to the present invention.

As shown in FIG. 1, FIG. 1 illustrates a control system 10 according to the present invention for a system according to the present invention which has a pump 12 that pumps drilling mud through a pipe 14 into a mud tank 16. A viscosity sensor 30 senses the viscosity of the mud in the tank 16; a density sensor 18 senses the density of the mud in the pipe 14; and, optionally, a density sensor 19 senses the density of mud in the tank 16. The density sensor can be outside the pipe 14 or in the mud in the tank 16. A centrifuge 40 (which can be any suitable known centrifuge with a rotatable bowl and a rotatable screw conveyor, including, e.g., a centrifuge as in FIG. 4) receives mud pumped by a pump 42 from the mud tank 16 and processes it to remove selected solids, thereby controlling and/or changing the viscosity of the mud. Selected solids are discharged from the centrifuge in a line 22 and the processed mud, with desirable solids therein, is reintroduced into the mud tank 16. The pump 42 may run continuously.

A computer system ("SBC") 70 controls an I/O module 50 and a variable frequency drives ("VFD") 60, 62, 64. VFD 60 controls bowl speed of the centrifuge 40. VFD 62 controls the screw conveyor of the centrifuge 40. VFD 64 controls a feed pump 42 that pumps drilling fluid or mud to the centrifuge 40. The system 70 computes a desired pump speed (pumping rate). A signal conditioner 20 controls the viscosity sensor 30 and provides power to it. Temperature sensors 24 monitor the temperature of bearings 26 of a centrifuge drive system and send signals indicative of measured temperatures to the Input/Output module 50. The functions of the I/O module 50 include sending data from the sensors to the system 70 and sending outputs from the system 70 to the VFD 60. The signal conditioner 20 sends signals to the I/O module 50 indicative of viscosity values measured by the viscosity sensor 30. The density sensor(s) sends signals indicative of measured mud densities to the I/O module. The I/O module provides density measurements to the computer system. The I/O module provides command signals from the system 70 to a variable frequency drive ("VFD") 60. As desired, one or more agitators may be used in the tank 16.

Continuous density measurements made by the density sensor(s) are used by the computer system 70 to determine a desired value for a mud viscosity set point (e.g. using known equations or a look-up table). The computer system 70 compares actual viscosity measurements from the viscosity sensor 30 (processed by the signal conditioner 20) to the determined desired value and then the computer system 70 calculates the difference between the predetermined set point and a current actual viscosity value. Following this calculation, the computer system 70 changes the operational parameters of the VFDs to run a bowl and/or conveyor of the centrifuge 40 faster or slower or to control pump speed. The computer system 70, which can run periodically or continuously, provides output(s) to a display device 80 (e.g. a monitor, screen, panel, laptop, handheld or desktop computer, etc., remote and/or on site.

Figure 2:
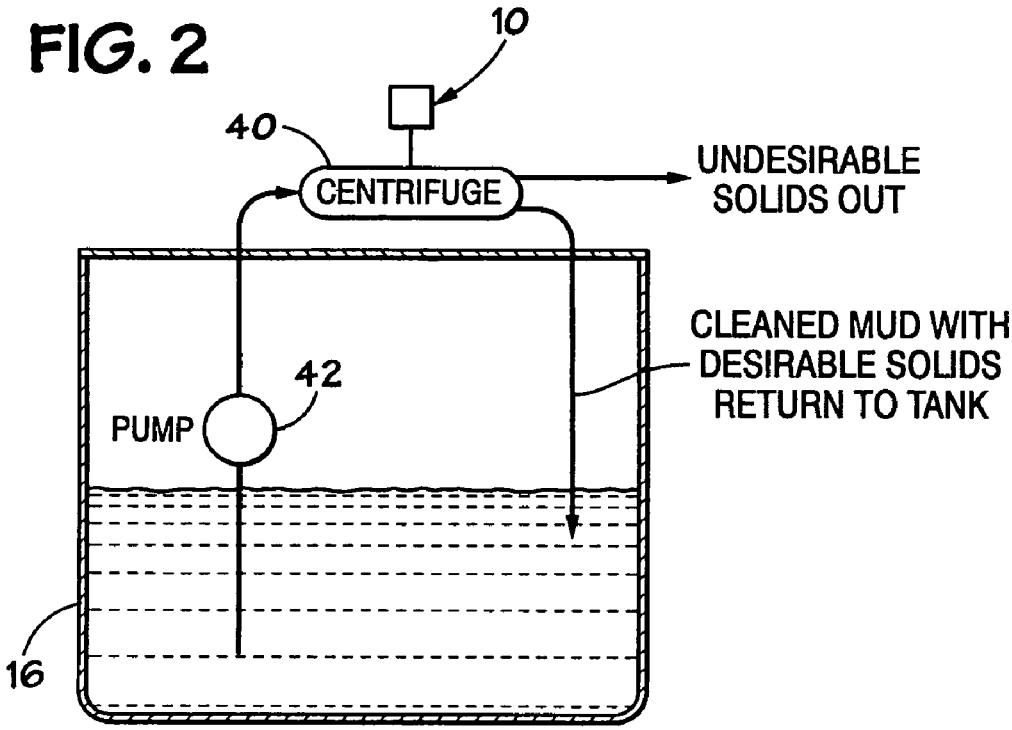
FIG. 2 is a schematic view of a centrifuge system according to the present invention.

FIG. 2 illustrates schematically a method according to the present invention using a system 10 according to the present invention for the removal of undesirable solids and the return of cleaned mud with desirable solids to a tank. In certain aspects, a system according to the present invention as in FIG. 2 is useful for controlling the density of drilling material.

In FIG. 2, solids returned to the tank 16 from the centrifuge 40 are desirable solids for use in the drilling fluid. In one aspect the centriguge of FIG. 2 is a "high speed" centrifuge operating at greater than 2200 RPMs. In certain particular aspects when used to control density the centrifuge 40 is run at a G-force of 700 G's or greater.

In one particular aspect the system of FIG. 2 is used to control the density of drilling material. The system receives input drilling material from a wellbore mud system (drilling fluid with entrained cuttings, solids, and/or debris pumped up from a wellbore). Typically some desirable solids, e.g. barite solids, have a density of about 4.2 and some drilled solids have a density of about 2.3. Density of the material is controlled by removing some, all or substantially all of the solids in the mud. Viscosity of the material is controlled by removing small barite solids (less than ten microns in a largest dimension) and/or small drilled solids (less than twenty microns in a smallest dimension). Solids are removed in the "Undesirable Solids—Out" line in FIG. 2, and, in one particular aspect, only (or substantially) cleaned mud is returned back into the tank 16 (no solids or only minimal solids are returned back into the tank 16). In one aspect, in the system of FIG. 2 large solids, e.g. barite solids, are returned to the tank 16 (e.g. solids with a largest dimension greater than 10 microns). In other aspects, such solids with a greatest largest dimension less than 20 microns are removed. In one aspect, such solids of a desired size, e.g. of or lesser than a selected largest dimension, are removed, e.g. a desired largest dimension between 1 and 20 microns.

Figure 3:
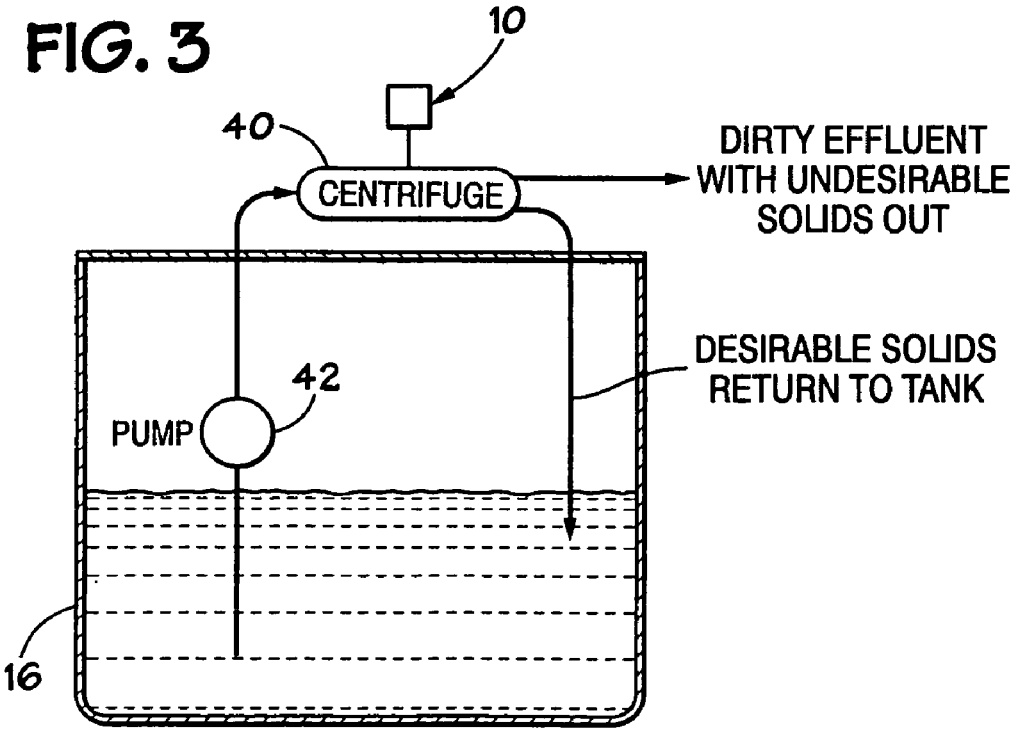
FIG. 3 is a schematic view of a centrifuge system according to the present invention.

FIG. 3 illustrates methods according to the present invention with a system 10 in which desirable solids, e.g. barite solids, are recovered and reintroduced into the mud in the tank 16. The centrifuge removes undesirable solids (e.g. fine solids with a largest dimension less than 5 microns) and returns desirable solids (e.g. solids with a largest dimension greater than 5 microns and/or of a specific material, e.g. barite) back to the tank for re-use. In one aspect the centrifuge of FIG. 3 is a low speed centrifuge operating at less than 2200 RPMs. In one particular aspect in which the system of FIG. 3 is used for viscosity control, the centrifuge is operated at a G-force of less than 1000 G's and, in one particular aspect, less than 700 G's.

Figure 5:
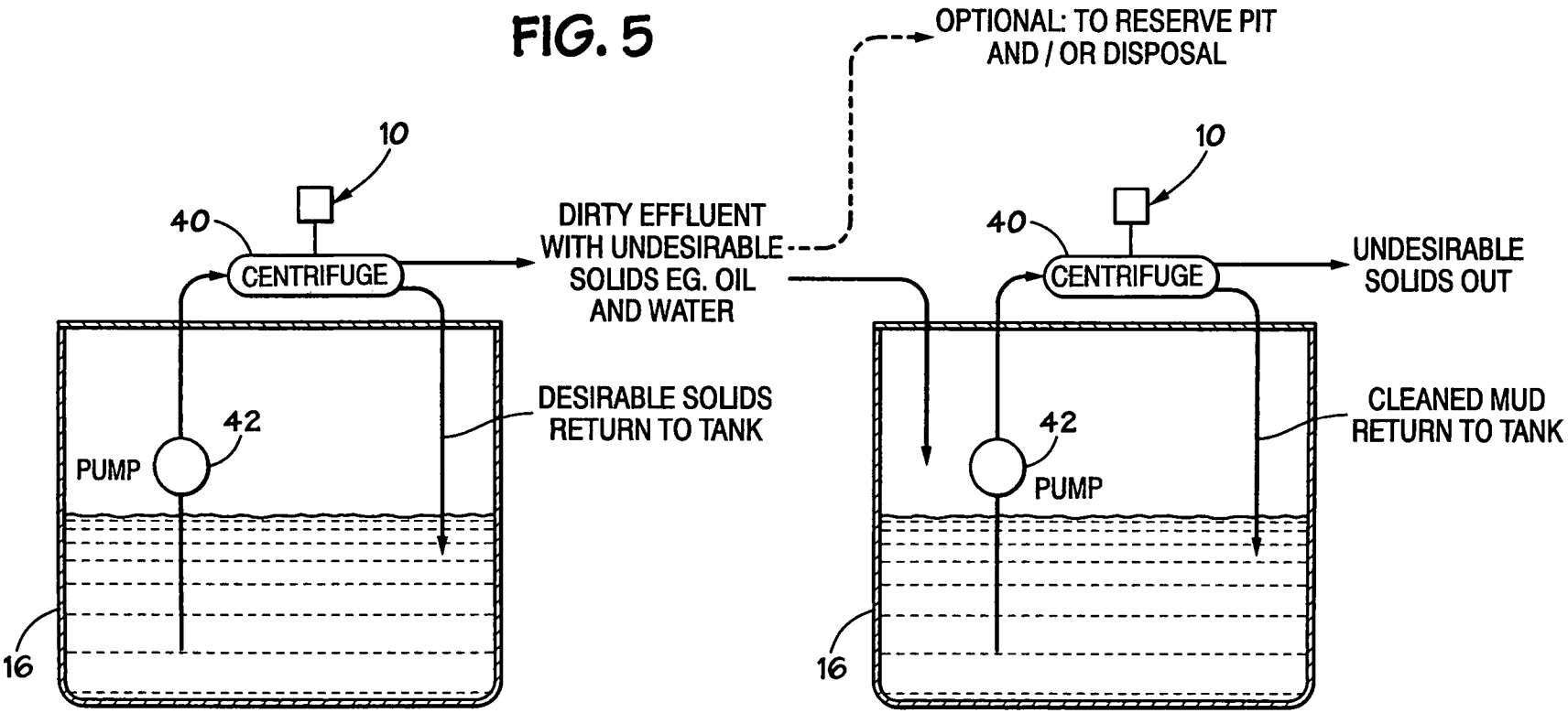
FIG. 5 is a schematic view of a system according to the present invention.

In one particular aspect the system of FIG. 3 is used to control viscosity of drilling material by removing viscosity-increasing solids, e.g. fine solids such as barite solids with a largest dimension less than or equal to ten microns and/or drilled solids with a largest dimension less than or equal to twenty microns. These removed solids flow out in the line labelled "Dirty Effluent With Undesirable Solids—Out". There may be some effluent, e.g. oil, with these solids. These solids and/or effluent may be pumped to a reserve pit, to disposal, or, as shown in FIG. 5, to a system as shown in FIG. 2 for further processing in accord with any embodiment of the FIG. 2 system. Optionally, in a viscosity-control system, recovered barite and/or recovered drilling solids (those not removed) are reintroduced back into the tank 16. Thus a desired viscosity of the drilling material is maintained by removing solids that increase viscosity.

In certain aspects, a system as in FIG. 2 is useful in building, reducing or maintaining a desired weight or desired density of mud.

A centrifuge can be turned off automatically to build weight, or to lower weight, or to hit or maintain a desired target density or density range.

The present invention, therefore, provides in at least some embodiments, a system for controlling viscosity of drilling fluid, the system including a container of drilling fluid material, the drilling fluid containing solids, a viscosity sensor for sensing viscosity of the drilling fluid material in the container and for producing viscosity signals indicative of said viscosity, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving viscosity signals from the viscosity sensor and for controlling the centrifuge and the pump apparatus in response to said viscosity signals so that selected solids from drilling fluid material processed by the centrifuge are removed or are reintroducible back into the container to control viscosity of drilling fluid material in the container. Such a system may have one or some, in any possible combination, of the following: wherein the control system and the pump apparatus are operable continuously; wherein each drive apparatus is a variable frequency drive; wherein the pump apparatus is operable at a selected pumping rate; density sensor apparatus for measuring density of the drilling fluid material and for producing density signals indicative of measured density, the control system including computer apparatus for receiving signals indicative of the density measured by the density sensor apparatus and for calculating a desired viscosity value based on said measured density, the computer apparatus for comparing the desired viscosity value to viscosity value as sensed by the viscosity sensor, and the computer apparatus for controlling the drive apparatuses to maintain sensed viscosity value at or near the desired viscosity value; the control system including computer apparatus, and display apparatus for displaying results of operation of the computer apparatus; wherein the centrifuge is a low speed centrifuge; wherein the centrifuge is operable to separate barite solids from the drilling fluid material and said barite solids are returnable to the container; and/or wherein the centrifuge is a high speed centrifuge.

The present invention, therefore, provides in certain, but not necessarily all embodiments, a system for controlling viscosity of drilling fluid, the system including a container of drilling fluid material, the drilling fluid containing solids, a viscosity sensor for sensing viscosity of the drilling fluid material in the container and for producing viscosity signals indicative of said viscosity, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving viscosity signals from the viscosity sensor and for controlling the centrifuge and the pump apparatus in response to said viscosity signals so that selected solids from drilling fluid material processed by the centrifuge are reintroducible back into the container to control viscosity of drilling fluid material in the container, wherein the control system and the pump apparatus are operable continuously, wherein the each drive apparatus is a variable frequency drive, wherein the pump apparatus is operable at a selected pumping rate, the control system including computer apparatus, and display apparatus for displaying results of operation of the computer apparatus.

The present invention, therefore, provides in certain, but not necessarily all embodiments, a system for controlling density of drilling fluid, the system including a container of drilling fluid material, the drilling fluid containing solids, a density sensor for sensing density of the drilling fluid material in the container and for producing density signals indicative of said density, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving density signals from the viscosity sensor and for controlling the centrifuge and the pump apparatus in response to said density signals so that selected solids from drilling fluid material processed by the centrifuge are reintroducible back into the container to control density of drilling fluid material in the container.

The present invention, therefore, provides in certain, but not necessarily all embodiments, a method for controlling viscosity of drilling fluid, the method including feeding drilling fluid material to a system for processing, the system as any disclosed herein for controlling viscosity, and controlling the centrifuge in response to viscosity signals to control the viscosity of the drilling fluid material in the container.

The present invention, therefore, provides in certain, but not necessarily all embodiments, a method for controlling density of drilling fluid, the method including feeding drilling fluid material to a system for processing, the system as any disclosed herein for controlling density, and controlling the centrifuge in response to density signals to control the density of the drilling fluid material in the container.

The present invention, therefore, provides in certain, but not necessarily all embodiments, a computer readable medium containing instructions that when executed by a computer implement a method according to the present invention (any method disclosed herein according to the present invention).

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accodance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all Of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A system for controlling viscosity of drilling fluid, the system comprising a container of drilling fluid material, the drilling fluid containing solids, a viscosity sensor for sensing viscosity of the drilling fluid material in the container and for producing viscosity signals indicative of said viscosity, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving viscosity signals from the viscosity sensor and for controlling the centrifuge and the pump apparatus in response to said viscosity signals so that selected solids from drilling fluid material processed by the centrifuge are removed to control viscosity of drilling fluid material in the container.

2. The system of claim 1 wherein the control system and the pump apparatus are operable continuously.

3. The system of claim 1 wherein each drive apparatus is a variable frequency drive.

4. The system of claim 1 wherein the pump apparatus is operable at a selected pumping rate.

5. The system of claim 1 further comprising the control system including computer apparatus for receiving signals indicative of the viscosity measured by the viscosity sensor apparatus and for calculating a desired viscosity value based on said measured viscosity, the computer apparatus for comparing the desired viscosity value to viscosity value as sensed by the viscosity sensor, and the computer apparatus for controlling the drive apparatuses to maintain sensed viscosity value at or near the desired viscosity value.

6. The system of claim 1 further comprising the control system including computer apparatus, and display apparatus for displaying results of operation of the computer apparatus.

7. The system of claim 1 wherein the centrifuge is run at a G-force of 1000 G's or less.

8. The system of claim 1 wherein the centrifuge is operable to separate barite solids of a largest dimension greater than or equal to ten microns from the drilling fluid material and said barite solids are returnable to the container.

9. The system of claim 1 wherein the selected solids include barite solids with a largest dimension of twenty microns or less.

10. The system of claim 1 wherein the selected solids include drilling solids with a largest dimension of twenty microns or less.

11. A system for controlling viscosity of drilling fluid, the system comprising a container of drilling fluid material, the drilling fluid containing solids, a viscosity sensor for sensing viscosity of the drilling fluid material in the container and for producing viscosity signals indicative of said viscosity, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, a control system for receiving viscosity signals from the viscosity sensor and for controlling the centrifuge and the pump apparatus in response to said viscosity signals so that selected solids from drilling fluid material processed by the centrifuge are removed to control viscosity of drilling fluid material in the container, wherein the control system and the pump apparatus are operable continuously, wherein the each drive apparatus is a variable frequency drive, wherein the pump apparatus is operable at a selected pumping rate, the control system including computer apparatus, and display apparatus for displaying results of operation of the computer apparatus.

12. The system of claim 11 further comprising density sensor apparatus for measuring density of the drilling fluid material and for producing density signals indicative of measured density, the control system including computer apparatus for receiving signals indicative of the density measured by the density sensor apparatus and for calculating a desired viscosity value based on said measured density, the computer apparatus for comparing the desired viscosity value to viscosity value as sensed by the viscosity sensor, and the computer apparatus for controlling the drive apparatuses to maintain sensed viscosity value at or near the desired viscosity value.

13. A system for controlling density of drilling fluid, the system comprising a container of drilling fluid material, the drilling fluid containing solids, a density sensor for sensing density of the drilling fluid material in the container and for producing density signals indicative of said density, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving density signals from the density sensor and for controlling the centrifuge and the pump apparatus in response to said density signals so that selected solids from drilling fluid material processed by the centrifuge are removed from the container to control density of drilling fluid material in the container to maintain density at a desired density value.

14. A method for controlling viscosity of drilling fluid material, the method comprising feeding drilling fluid material to a system for processing, the system comprising a container of drilling fluid material, the drilling fluid containing solids, a viscosity sensor for sensing viscosity of the drilling fluid material in the container and for producing viscosity signals indicative of said viscosity, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving viscosity ,signals from the viscosity sensor and for controlling the centrifuge and the pump apparatus in response to said viscosity signals so that selected solids from drilling fluid material processed by the centrifuge are removed to control viscosity of drilling fluid material in the container, and controlling the centrifuge in response to viscosity signals to control the viscosity of the drilling fluid material in the container.

15. The method of claim 14 wherein the system further comprises density sensor apparatus for measuring density of the drilling fluid material and for producing density signals indicative of measured density, the control system including computer apparatus for receiving signals indicative of the density measured by the density sensor apparatus and for calculating a desired viscosity value based on said measured density, the computer apparatus for comparing the desired viscosity value to viscosity value as sensed by the viscosity sensor, and the computer apparatus for controlling the drive apparatuses to maintain sensed viscosity value at or near the desired viscosity value, the method further comprising comparing with the computer apparatus the desired viscosity value to the sensed viscosity value, and controlling the drive apparatuses to maintain the sensed viscosity value at or near the desired viscosity value.

16. The method of claim 14 wherein the control system and the pump apparatus are operable continuously, the method further comprising continuously controlling the viscosity of the drilling fluid material.

17. The method of claim 14 wherein the centrifuge separates barite solids of a largest dimension greater than or equal to ten microns from the drilling fluid material and said barite solids are returnable to the container, the method further comprising recovering said barite solids with the centrifuge, and returning the recovered barite solids to the container.

18. The method of claim 14 further comprising operating the centrifuge at a G-force of 700 G's or less.

19. The method of claim 14 wherein the selected solids include barite solids with a largest dimension of ten microns or less.

20. The method of claim 14 wherein the selected solids include drilled solids with a largest dimension of twenty microns or less.

21. A method for controlling density of drilling fluid material, the method comprising feeding drilling fluid material to a system for processing, the system comprising a container of drilling fluid material, the drilling fluid containing solids, a density sensor for sensing density of the drilling fluid material in the container and for producing density signals indicative of said density, a centrifuge for removing solids from the drilling fluid material, the centrifuge having a rotatable bowl and a rotatable screw conveyor, pump apparatus for pumping drilling fluid material from the container to the centrifuge, bowl drive apparatus for driving the rotatable bowl, conveyor drive apparatus for driving the rotatable conveyor, pump drive apparatus for driving the pump apparatus, and a control system for receiving density signals from the density sensor and for controlling the centrifuge and the pump apparatus in response to said density signals so that selected solids from drilling fluid material processed by the centrifuge are removed to control density of drilling fluid material in the container, and controlling the centrifuge in response to density signals to control the density of the drilling fluid material in the container.

* * * * *